US009583088B1

(12) United States Patent
May et al.

(10) Patent No.: US 9,583,088 B1
(45) Date of Patent: Feb. 28, 2017

(54) FREQUENCY DOMAIN TRAINING TO COMPENSATE ACOUSTIC INSTRUMENT PICKUP SIGNALS

(71) Applicant: Audio Sprockets LLC, Nevada City, CA (US)

(72) Inventors: James May, Nevada City, CA (US); Andrew Leon Norrell, Orinda, CA (US)

(73) Assignee: Audio Sprockets LLC, Nevada City, CA (US)

( * ) Notice: Subject to any disclaimer, the term of this patent is extended or adjusted under 35 U.S.C. 154(b) by 0 days.

(21) Appl. No.: 14/946,609

(22) Filed: Nov. 19, 2015

Related U.S. Application Data

(60) Provisional application No. 62/084,128, filed on Nov. 25, 2014.

(51) Int. Cl.
*G10H 1/08* (2006.01)
*G10H 7/00* (2006.01)
*G10H 3/18* (2006.01)

(52) U.S. Cl.
CPC ..... *G10H 3/186* (2013.01); *G10H 2250/075* (2013.01); *G10H 2250/235* (2013.01)

(58) Field of Classification Search
CPC ..... G10H 3/186; G10H 2250/075; G10H 2250/235
USPC ..... 84/625
See application file for complete search history.

(56) References Cited

U.S. PATENT DOCUMENTS 6,448,488 B1 9/2002 Ekhaus et al.
8,143,509 B1 3/2012 Robertson et al.
8,735,711 B2 5/2014 Kuroki
8,859,874 B2 10/2014 Kuroki
9,099,069 B2 8/2015 Shinoda et al.
9,280,964 B2 * 3/2016 Lin ..... G10H 3/182
2006/0147050 A1 * 7/2006 Geisler ..... G10H 1/0091 381/61
2008/0034946 A1 * 2/2008 Aimi ..... G10H 3/146 84/604
2009/0173218 A1 * 7/2009 Kuroki ..... G10H 3/186 84/629

(Continued)

OTHER PUBLICATIONS

Karjalainen, M., et al., DSP Equalization of Electret Film Pickup for the Acoustic Guitar, J. Audio Eng. Soc., Dec. 2000, p. 1183-93, vol. 48, No. 12, AES, New York, NY.

*Primary Examiner* — Jeffrey Donels
(74) *Attorney, Agent, or Firm* — Craige Thompson; Thompson Patent Law

(57) ABSTRACT

Apparatus and associated methods relate to training FIR filter coefficients by deconvolving a first input signal and a second input signal in the frequency domain, both of the signals being generated in response to an undetermined broadband excitation applied to an acoustic body instrument, until a fidelity of the second signal convolved with the trained coefficients meets predetermined fidelity criteria relative to the first signal. In an illustrative example, a musical instrument pickup signal and a microphone signal from the musical instrument may be sampled, segmented, and transformed to the frequency domain. FIR filter coefficients may be, for example, trained by block deconvolution in the frequency domain of the microphone signal and the pickup signal. In various examples, the trained FIR filter coefficients may adapt the pickup signal to mimic microphone performance, including full-body acoustic content.

22 Claims, 7 Drawing Sheets

(56) References Cited

U.S. PATENT DOCUMENTS

| | | | | |
|---|---|---|---|---|
| 2010/0260347 | A1* | 10/2010 | Baggs | H04R 3/007 381/71.2 |
| 2013/0022210 | A1 | 1/2013 | Vainiala | |
| 2014/0260906 | A1* | 9/2014 | Welch | G10H 3/182 84/603 |

* cited by examiner

FREQUENCY DOMAIN TRAINING TO COMPENSATE ACOUSTIC INSTRUMENT PICKUP SIGNALS

CROSS-REFERENCE TO RELATED APPLICATIONS

This application also claims the benefit of U.S. Provisional Application Ser. No. 62/084,128, titled "Adaptive Tone Compensation System for Acoustic Stringed Instruments," filed by May, et al., on Nov. 25, 2014. This application incorporates the entire contents of the foregoing application herein by reference.

TECHNICAL FIELD

Various embodiments relate generally to audio signal processing devices, and more specifically to frequency domain training of filter coefficients and the application of the trained filter for real-time optimization of acoustic instrument pickup signals.

BACKGROUND

Advances in audio signal processing technology have provided devices useful for adjusting the sound of musical instruments. Audio signal processing devices that adapt the captured sound of a musical instrument may supply useful benefits to musicians in a variety of contexts.

Some audio signal processing devices provide one or more musical instrument sound adaptation functions. Examples of devices providing musical instrument sound adaptation functions include devices designed and manufactured to adapt the sound of a particular instrument. In some systems, the musician may adapt instrument sound by manually adjusting various tone controls, for example.

SUMMARY

Apparatus and associated methods relate to training FIR filter coefficients by deconvolving a first input signal and a second signal in the frequency domain, both of the signals being generated in response to an undetermined broadband excitation applied to an acoustic body instrument, until the FIR filter coefficients meet predetermined fidelity criteria. In an illustrative example, a musical instrument pickup signal and a microphone signal from the musical instrument may be sampled, segmented, and transformed to the frequency domain. FIR filter coefficients may be, for example, trained by block deconvolution in the frequency domain of the microphone signal and the pickup signal. In various examples, the trained FIR filter coefficients may adapt the pickup signal to mimic microphone performance, including full-body acoustic content.

Various embodiments may achieve one or more advantages. For example, a wide array of acoustic instrument performing musicians may use exemplary embodiments to train a music system to permit them to perform with a pickup for amplification; however, such embodiments may enable these musicians to perform with the benefits of a pickup without having to compromise on rich sound quality provided by a microphone input. For example, some embodiments retain the rich sound of a microphone while providing the convenience of a pickup, e.g., the mobility to move away from a cumbersome fixed position relative to a microphone. Some embodiments may compensate for the raw (e.g., substantially absent of resonant cavity harmonics) sound of a musical instrument as captured by a pickup, by translating the pickup signal to mimic a "full body" sound of the musical instrument as if captured by a microphone. In an illustrative example, the sound of a musical instrument captured by a microphone includes the "body effect" of the physical structure of the musical instrument's response to the musician playing the instrument. The sound of the same musical instrument as captured by a pickup internal to the musical instrument may not include the "body effect." Some exemplary devices may combine training and performance into an integrated module, which may be further capable of receiving user input to modify the trained FIR filter coefficients for various effects. In various embodiments, the frequency domain compensation methods may provide capabilities to modify the sound of a musical instrument to make one instrument sound more like another, or to provide enhancements to an instrument for particular venues or performance objectives.

For example, players of acoustic stringed instruments may need to amplify their instruments to reach larger audiences than the few people who could sit directly in front of the instrument while it is being played. When this is done using an internal pickup, the tonal quality of the instrument is significantly degraded. Exemplary devices may restore the rich natural tone of the instrument such that it sounds like it is being amplified by a microphone rather than a pickup, without the need for a microphone during the performance, and without the associated feedback and without the need for the performer to maintain a constant position relative to a microphone.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, the application of a musical instrument sound adaptation device providing frequency domain training of a filter coefficient block for translating a pickup signal to an approximation of a microphone signal, is introduced with reference to FIG. 1. Second, with reference to FIG. 2, the discussion turns to exemplary operational scenarios, for a musical instrument sound adaptation device providing frequency domain training of a filter coefficient block. Specifically, exemplary operational and signal flows are presented to illustrate both the frequency domain processing in train mode for training a filter coefficient block to translate a pickup signal to an approximation of a microphone signal, and the insertion of the trained filter coefficient block in the pickup signal path to translate a pickup signal to an approximation of a microphone signal in perform mode. Third, with reference to FIG. 3, a signal flow for processing a microphone signal and a pickup signal in the frequency domain, to train a filter coefficient block for translating the pickup signal to an approximation of the microphone signal, including accumulation of the deconvolution result and transformation of the trained accumulator to the time domain for convolution with the pickup signal in perform mode, is presented. Fourth, with reference to FIG. 4, an operational flow of an exemplary algorithm for processing a microphone signal and a pickup signal in the frequency domain, to train a filter coefficient block for translating the pickup signal to an approximation of the microphone signal, including the operations performed to obtain, test, and accumulate the deconvolution estimate, is presented. Fifth, with reference to FIG. 5, an operational flow of an exemplary method for using an acoustic instrument pickup signal compensation apparatus to train an acoustic instrument pickup compensator, including adjusting input levels, exercising the musical instrument during training, and determining if training is complete, is presented. Sixth, with reference to FIG. 6, the structure of an exemplary musical instrument sound adaptation device providing frequency domain training of a filter in a train mode, and translation of the pickup signal to an approximation of the microphone signal in a perform mode, including an audio input/output system, processor, user interface, and digital signal processing system, is presented. Finally, with reference to FIG. 7, an operational flow of an exemplary digital signal processing system providing frequency domain training of a filter in a train mode, and translation of the pickup signal to an approximation of the microphone signal in a perform mode, including an illustration of exemplary signal flows in train and perform modes, is presented.

Figure 1:
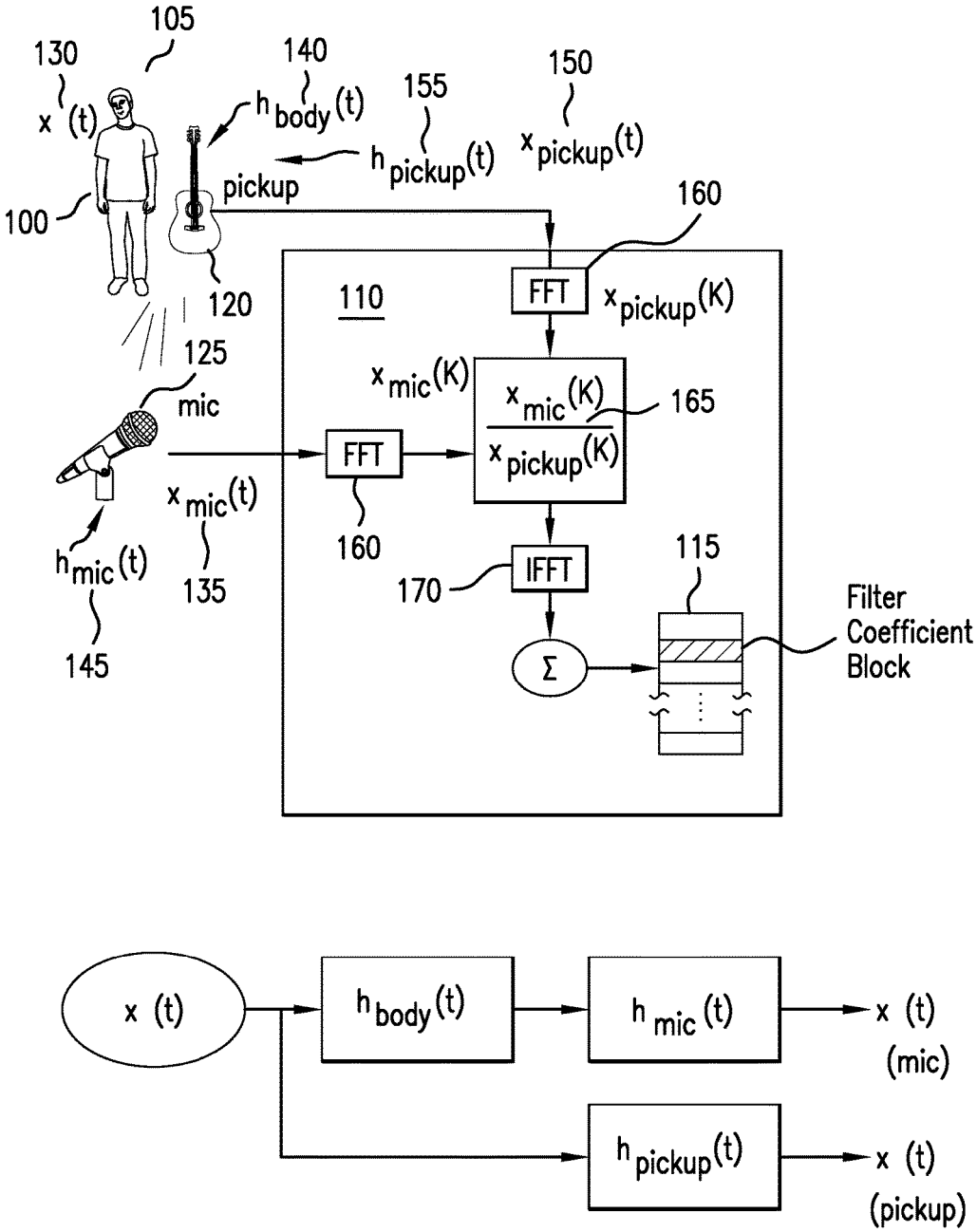
FIG. 1 depicts an exemplary musical instrument sound adaptation device processing a microphone signal and a pickup signal in the frequency domain, to train a filter coefficient block for translating the pickup signal to an approximation of the microphone signal.

FIG. 1 depicts an exemplary musical instrument sound adaptation device processing a microphone signal and a pickup signal in the frequency domain, to train a filter coefficient block for translating the pickup signal to an approximation of the microphone signal. In FIG. 1, a musician 100 is playing an acoustic musical instrument 105 in a training scenario. The musician is using the exemplary musical instrument sound adaptation device 110 to train the filter coefficient block 115 for use in adapting the sound of the musical instrument. The musical instrument sound adaptation device trains the filter coefficient block by processing the acoustic instrument pickup 120 signal and the microphone 125 signal in the frequency domain. In an illustrative example, the trained filter coefficient block may be used to adapt the pickup signal to an approximation of the microphone signal, for use without a microphone in a performance scenario. Exemplary devices may further permit an acoustic instrument musician to obtain the rich sound provided by a microphone while enjoying the freedom of using a pickup instead of a microphone.

In an illustrative example, the musical instrument sound adaptation device trains the filter coefficient block by deconvolving a microphone input signal and a pickup signal in the frequency domain, both of the signals being generated in response to an undetermined broadband string excitation applied to an acoustic body instrument. The training process may continue until a fidelity of the pickup signal convolved with the trained coefficients meets predetermined fidelity criteria. In some embodiments, the predetermined fidelity criteria may be determined based on the microphone signal, for example. In FIG. 1, the physical actions of the musician playing the instrument provide the string excitation x(t), 130, to the acoustic body musical instrument. The string excitation produces responses captured by the microphone and instrument pickup. The signals captured are functions of the system response of the signal paths. The signal captured by the microphone is the response to x(t), $x_{mic}(t)$, 135, by the combination of the response of the acoustic body instrument 140, $h_{body}(t)$, and the response of the microphone 145, $h_{mic}(t)$, that is, $x_{mic}(t)=x(t)*h_{body}(t)*h_{mic}(t)$, with*representing time domain convolution. The signal captured by the instrument pickup is the response to x(t), $x_{pickup}(t)$, 150, by the instrument pickup response $h_{pickup}(t)$, 155, that is, $x_{pickup}(t)=x(t)*h_{pickup}(t)$, with*representing time domain convolution. In an illustrative example, the musical instrument sound adaptation device samples, buffers, segments, and packetizes the signal $h_{pickup}(t)$ captured by the pickup, and the signal $x_{mic}(t)$ captured by the microphone. The musical instrument sound adaptation device transforms both packetized signals to the frequency domain using FFTs 160, deconvolves the packetized frequency domain microphone and packetized frequency domain pickup signal, and accumulates the result of the deconvolution, $X(k)_{mic}/X(k)_{pickup}$, 165. When training is complete, the musical instrument sound adaptation device transforms the accumulated deconvolution to the time domain using an IFFT 170, to obtain trained FIR filter coefficients, and stores the resulting filter coefficient block for use in adapting the sound of the musical instrument in a performance scenario.

Figure 2:
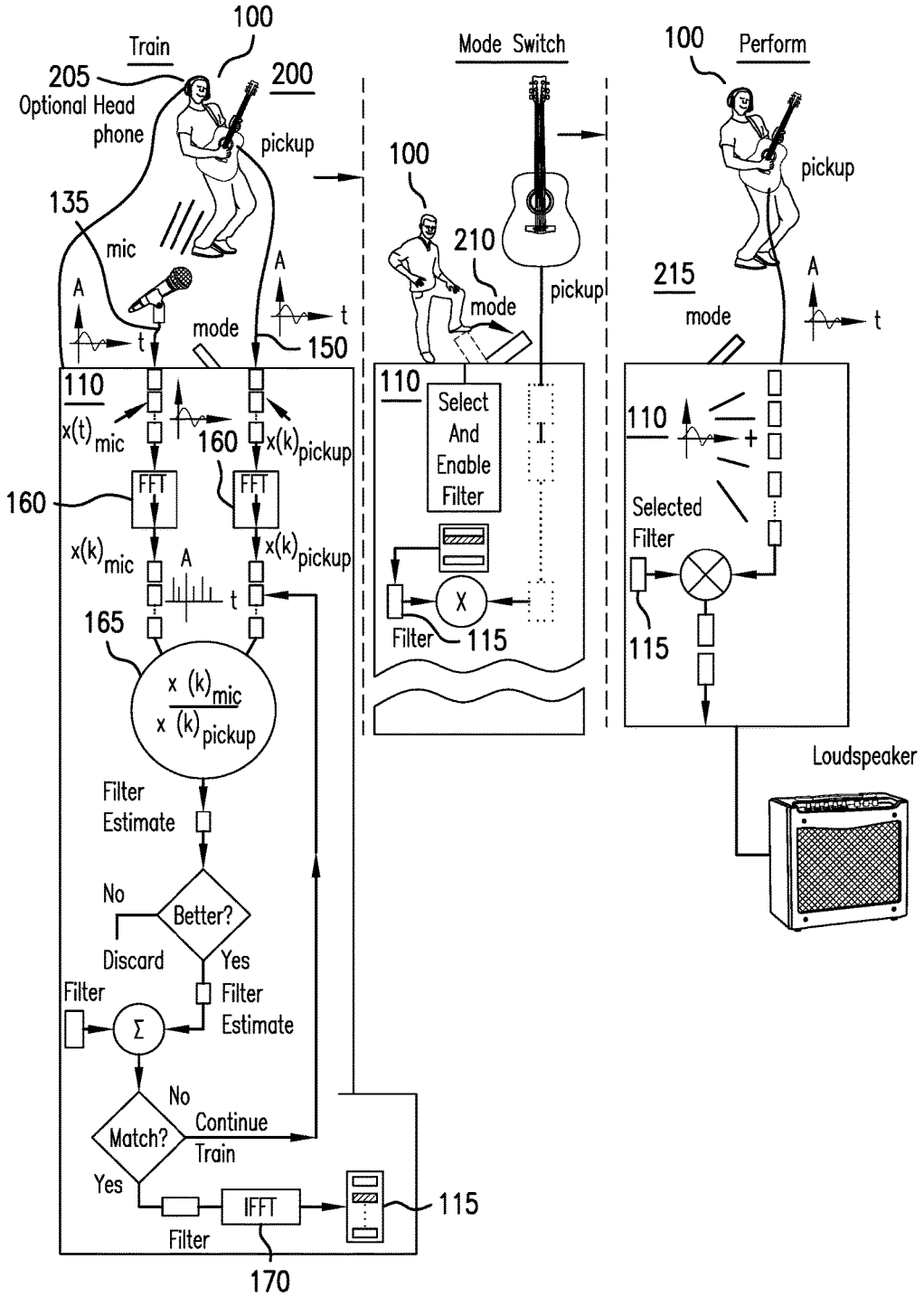
FIG. 2 depicts an exemplary musical instrument sound adaptation device in several operational contexts: operating in train mode to train a filter in the frequency domain; switching from train mode to perform mode; and operating in perform mode to translate the pickup signal to an approximation of the microphone signal, with the microphone disconnected.

FIG. 2 depicts an exemplary musical instrument sound adaptation device in several operational contexts: operating in train mode to train a filter in the frequency domain; switching from train mode to perform mode; and operating in perform mode to translate the pickup signal to an approximation of the microphone signal, with the microphone disconnected. In FIG. 2, the musician 100 is playing an acoustic musical instrument in a training scenario 200 and monitoring the training progress using headphone 205. The musician is using the exemplary musical instrument sound adaptation device 110 to train the filter coefficient block 115 for use in adapting the sound of the musical instrument. In an illustrative example, the musical instrument sound adaptation device samples, buffers, segments, and packetizes the signal $x_{mic}(t)$ 135 captured by the microphone, and the signal $x_{pickup}(t)$ 150 captured by the pickup. The musical instrument sound adaptation device transforms both packetized signals to the frequency domain using FFTs 160, deconvolves the packetized frequency domain microphone and packetized frequency domain pickup signal by computing $X_{mic}(k)/X_{pickup}(k)$ to obtain a filter estimate. Each filter estimate is evaluated by various criteria to determine the likelihood that it is a useful contributor to the accumulation process which is "growing" the estimate to obtain a sufficiently good filter. If a filter estimate is not a useful contributor to the accumulation process, the filter estimate is discarded and training continues. Every time a new block is contributed, the accumulator is evaluated to determine if a sufficiently good estimate has been achieved. When a sufficiently good estimate has been achieved, training completes, otherwise training continues. When training has completed, mode switch 210 may engage perform mode by selecting a trained filter coefficient block 115 and inserting the trained coefficient block in the acoustic instrument pickup processing path filter to adapt the pickup signal $x_{pickup}(t)$ to an approximation of the microphone signal, for use without a microphone in a performance scenario 215.

Figure 3:
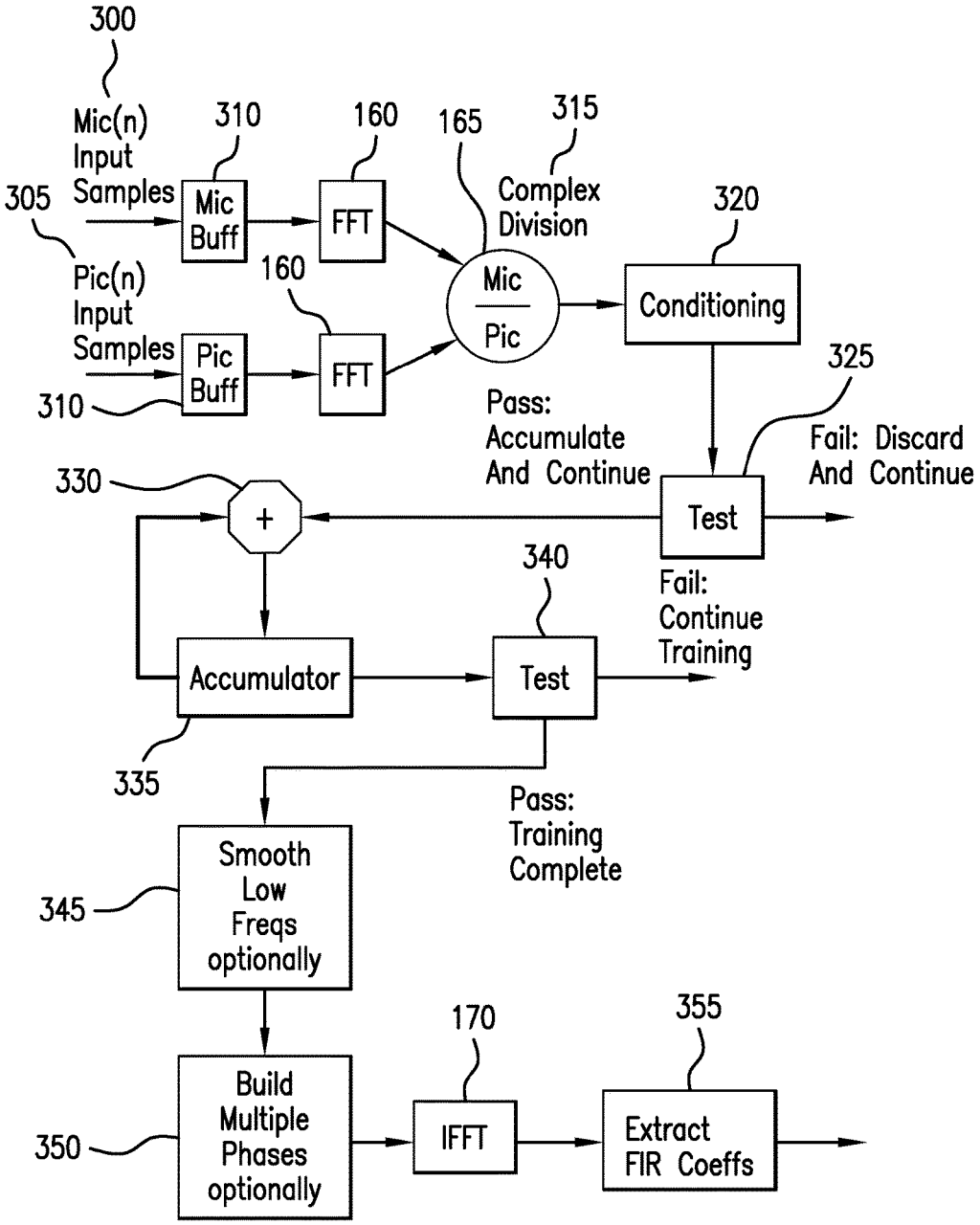
FIG. 3 depicts an exemplary signal flow for processing a microphone signal and a pickup signal in the frequency domain, to train a filter coefficient block for translating the pickup signal to an approximation of the microphone signal.

FIG. 3 depicts an exemplary signal flow for processing a microphone signal and a pickup signal in the frequency domain, to train a filter coefficient block for translating the pickup signal to an approximation of the microphone signal. As illustrated in FIG. 3, microphone input samples 300 and pickup input samples 305 are buffered and packetized 310 into blocks of samples. In an illustrative example, the size of input sample blocks may be substantially larger than the filter size. In an illustrative example, the filter size may range from 2048 to 8192 samples. By way of example and not limitation, the length of input sample blocks may be between about 4096 and about 65536, although those of ordinary skill may recognize how the length of input sample blocks is a parameter that may be set outside this range to meet performance specifications.

The input sample blocks may be transformed into the frequency domain using FFTs 160. The complex output of the FFT of the microphone input sample blocks are divided 315 by the complex output of the FFT of the pickup input sample blocks to yield a frequency domain estimate 165 of the deconvolution. The frequency domain estimate of the deconvolution is conditioned 320 for analysis according to techniques known in the art, which may include windowing, scaling, normalization of magnitude or phase, or other techniques. The conditioned frequency domain estimate of the deconvolution is subjected to a test 325 to determine if it would be a constructive contributor to the training accumulator. Testing is done by comparing the quotient vector to a model developed from the known characteristics of stringed instruments. The quotient vector is added 330 to the training accumulator 335 if it would be a constructive contributor, otherwise the quotient vector is discarded. The training accumulator is tested 340 periodically to see if a sufficiently good result has been achieved, by comparing it to a template of what a known good filter looks like. If not, training continues as more blocks are processed; otherwise, the training process is considered complete and stops. The resulting primary filter, still in the frequency domain, is optionally processed 345 to alter both magnitude and phase to further enhance characteristics that are desirable for performance. In an illustrative example, magnitude smoothing of certain spectral points may improve feedback immunity, and minimum phase transformation may provide a more punchy timbre. In an illustrative example, several derivations of the primary filter may be generated. In an illustrative example, the resulting primary filter may be used as a starting point for further refinement such that multiple filters with altered phase response are derived 350. In an illustrative example, primary filters are converted to the time domain using an IFFT 170 and FIR coefficients are extracted 355 for use in the convolver to adapt the pickup signal $x_{pickup}(t)$ to an approximation of the microphone signal, even in the absence of a microphone in a performance scenario.

Figure 4:
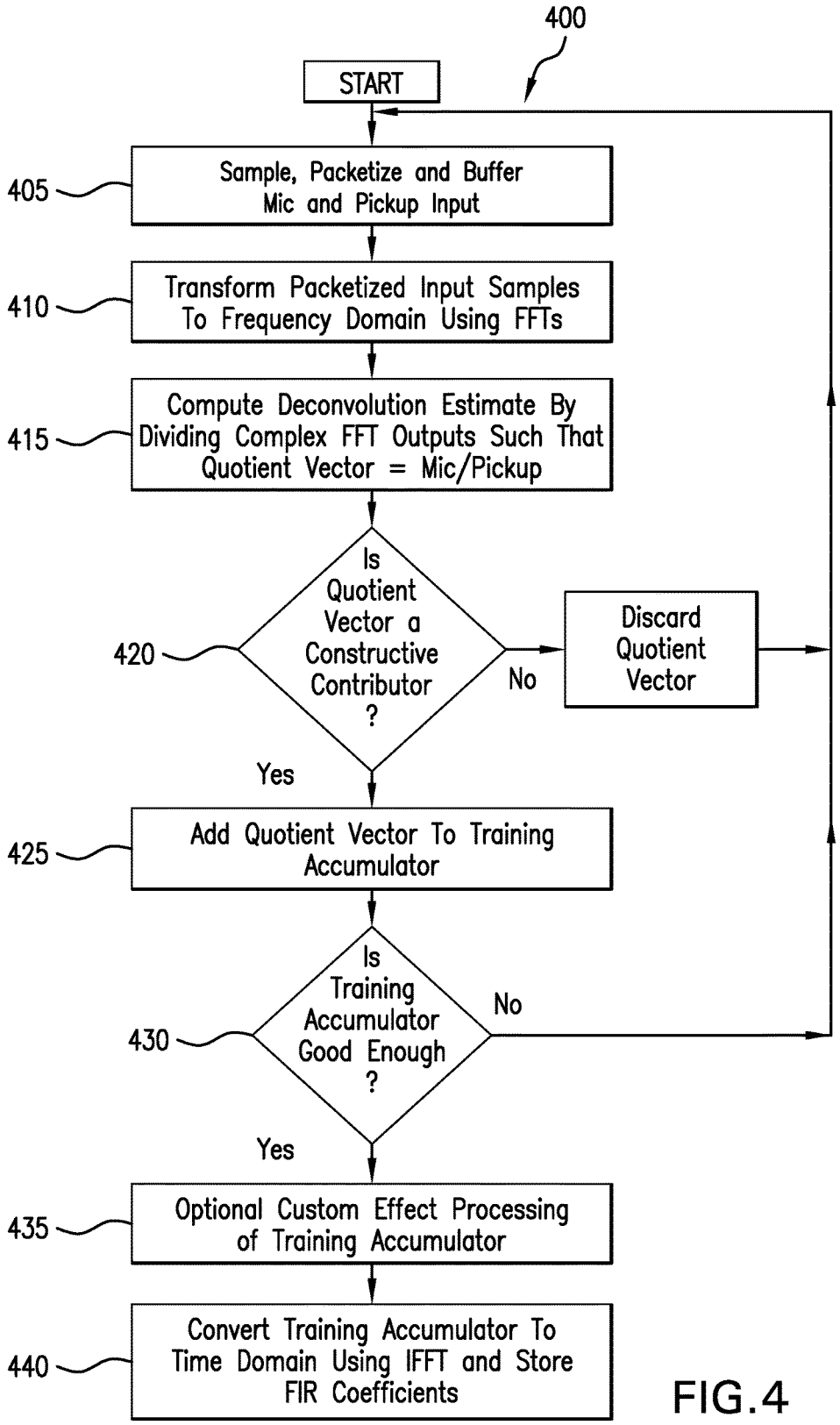
FIG. 4 depicts an operational flow of an exemplary algorithm for processing a microphone signal and a pickup signal in the frequency domain, to train a filter coefficient block for translating the pickup signal to an approximation of the microphone signal.

FIG. 4 depicts an operational flow of an exemplary algorithm for processing a microphone signal and a pickup signal in the frequency domain, to train a filter coefficient block for translating the pickup signal to an approximation of the microphone signal. In FIG. 4, a computer-implemented method 400 is disclosed for processing a microphone signal and a pickup signal in the frequency domain, to train a filter coefficient block for translating the pickup signal to an approximation of the microphone signal. In some examples, steps of the method may be performed by a processor, such as the digital signal processor 605, which will be described with reference to FIG. 6, alone or in combination with one or more auxiliary circuits.

In a first stage, at step 405, a microphone and pickup inputs are sampled, segmented, packetized, and buffered. In a second stage, at step 410, the packetized input samples are transformed to the frequency domain using FFTs. In a third stage, at step 415, an estimate of the deconvolution of the microphone and pickup inputs is computed by dividing the complex FFT outputs to yield a quotient vector. In a fourth stage, at step 420, a test is performed to determine if the quotient vector will be a constructive contributor to the accumulation process which is "growing" the estimate to obtain a sufficiently good filter. Upon a determination the quotient vector will not be a constructive contributor to the accumulation process which is "growing" the estimate to obtain a sufficiently good filter, the quotient vector is discarded and processing continues at step 405. Upon a determination the quotient vector will be a constructive contributor to the accumulation process which is "growing" the estimate to obtain a sufficiently good filter, processing proceeds to a fifth stage, at step 425, and the quotient vector is added to the training accumulator. In a sixth stage, at step 430, a test is performed to determine if a sufficiently good filter has been achieved. Upon a determination a sufficiently good filter has not been achieved, processing may continue at step 405. Upon a determination a sufficiently good filter has been achieved, processing proceeds to a seventh stage, at step 435, for training accumulator custom effect processing. In an eighth stage, at step 440, the training accumulator is transformed to the time domain using an IFFT, and the FIR coefficients are stored.

Figure 5:
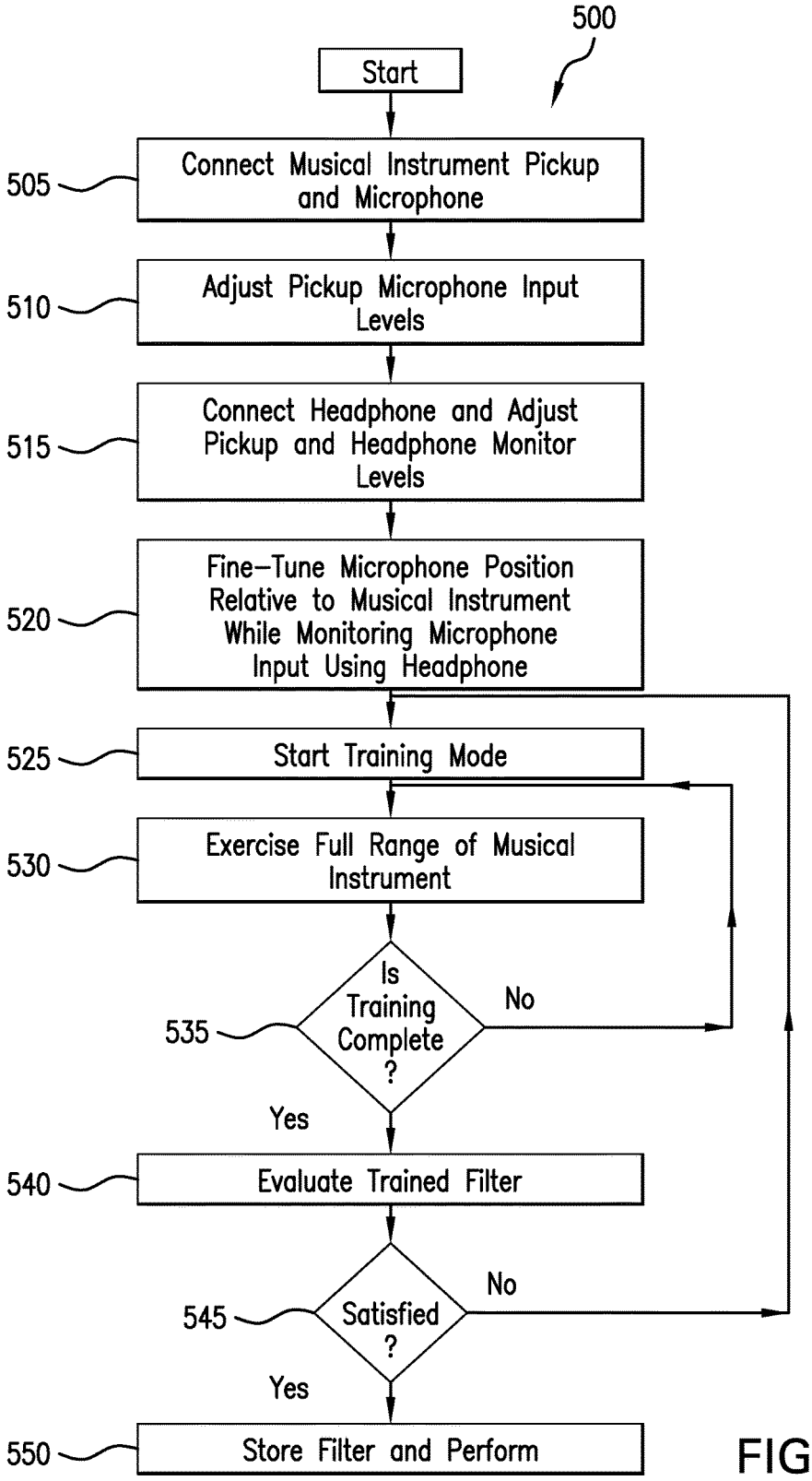
FIG. 5 depicts an operational flow of an exemplary method for using an acoustic instrument pickup signal compensation apparatus to train an acoustic instrument pickup compensator.

FIG. 5 depicts an operational flow of an exemplary method for using an acoustic instrument pickup signal compensation apparatus to train an acoustic instrument pickup compensator. In FIG. 5, a method 500 is disclosed for using an acoustic instrument pickup signal compensation apparatus to train an acoustic instrument pickup compensator. In a first stage, at step 505, a musical instrument and a microphone are connected to the acoustic instrument pickup signal compensation apparatus. In a second stage, at step 510, the pickup and microphone input levels are adjusted. In a third stage, at step 515, a headphone is connected to the acoustic instrument pickup signal compensation apparatus, and the pickup and headphone monitor levels are adjusted. In a fourth stage, at step 520, the microphone position relative to the musical instrument is fine-tuned while monitoring the microphone input using the headphone connected to the acoustic instrument pickup signal compensation apparatus. In a fifth stage, at step 525, training mode is started. In a sixth stage, at step 530, training is performed by exercising the full range of the musical instrument. In a seventh stage, at step 535, a test is performed to determine if training is complete. Upon a determination training is not complete, processing may continue with further training at step 530. Upon a determination training is complete, processing proceeds to an eighth stage, at step 540, where the trained filter is evaluated. In a ninth stage, at step 545, a test is performed to determine if the trained filter is satisfactory. Upon a determination the trained filter is not satisfactory, processing may continue with further training at step 525. Upon a determination the trained filter is satisfactory, processing proceeds to a tenth stage, at step 550, where the trained filter is stored for use in perform mode. In some implementations, at desired points during the training process, the performance signal path response may optionally be monitored by an observer (e.g., musician, engineer, etc.) who is wearing headphones, for example.

Figure 6:
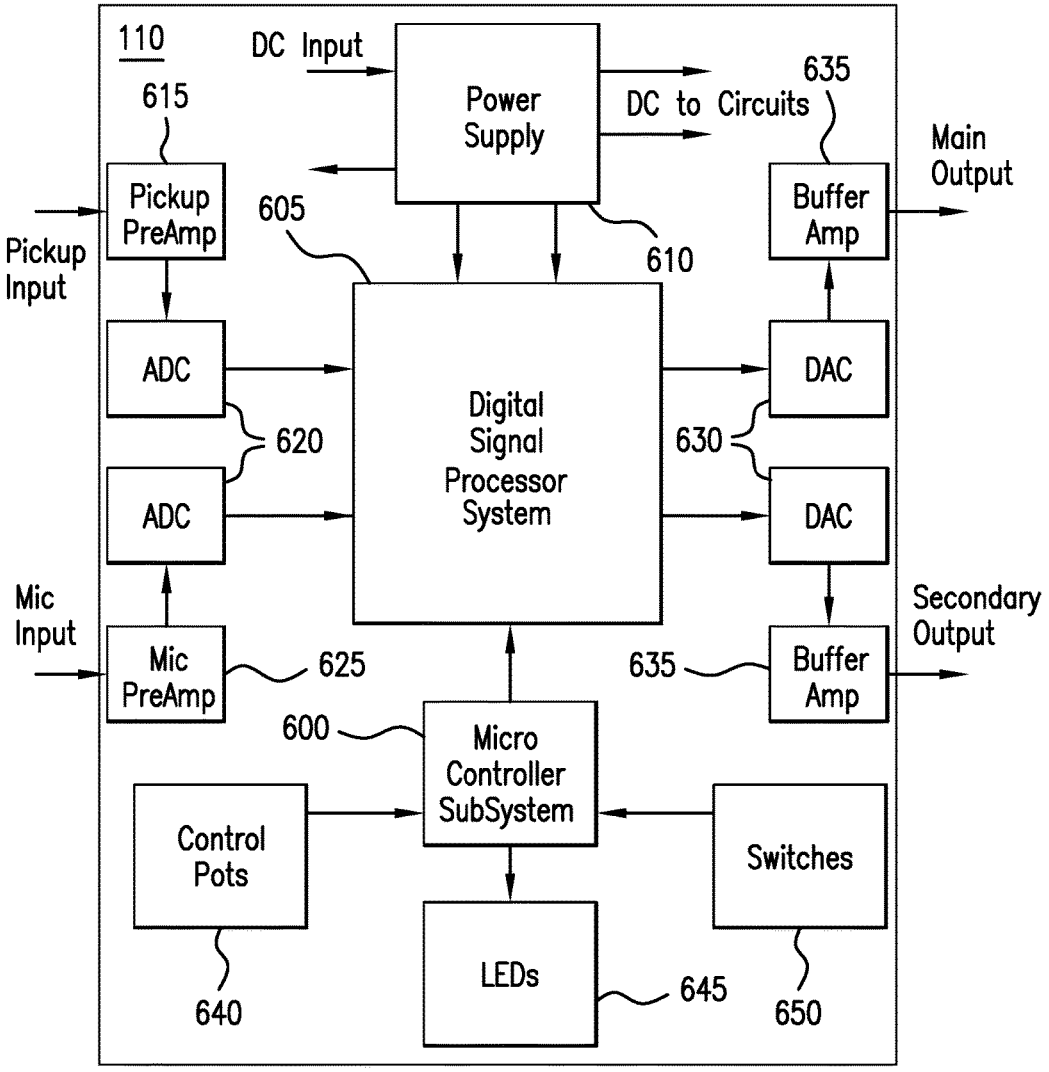
FIG. 6 depicts the structure of an exemplary musical instrument sound adaptation device providing frequency domain training of a filter in a train mode, and translation of the pickup signal to an approximation of the microphone signal in a perform mode.

FIG. 6 depicts the structure of an exemplary musical instrument sound adaptation device providing frequency domain training of a filter in a train mode, and translation of the pickup signal to an approximation of the microphone signal in a perform mode. As illustrated in FIG. 6, an exemplary musical instrument sound adaptation device 110 includes: a microcontroller sub-system 600; a digital signal processor system 605; a power supply 610; a pickup preamplifier 615, analog-to-digital converters 620, a microphone preamplifier 625, digital-to-analog converters 630, buffer amplifiers 635, control potentiometers 640, LEDs 645, and switches 650.

In various examples, the power supply may take in 9-15 Volts DC, and generate all of the voltages needed by the various analog and digital devices in the system. The pickup preamplifier may receive an analog waveform from the musical instrument pickup, amplify it to a level appropriate for the analog-to-digital converter, which is then converted to a digital representation suitable for processing by the digital signal processor system. The microphone preamplifier may receive an analog waveform from the microphone, amplify it to a level appropriate for the analog-to-digital converter, which is then converted to a digital representation suitable for processing by the digital signal processor system. In an illustrative example, there may be a user interface under control of the microcontroller sub-system which reads the settings of the control potentiometers and the switches to determine the appropriate functionality of the device, and communicates the necessary control information to various blocks of the digital signal processor system. In an illustrative example, the microcontroller sub-system also controls a number of LEDs that are used to inform the user about current state of training, tuning, or other functions. In an illustrative example, the pickup preamplifier, analog to digital converters, mic preamp, digital to analog converters, and buffer amplifiers may comprise an audio input/output system. In an illustrative example, the switches may include input from foot switches or pedals. In an illustrative example, the operation and effect of the control potentiometers, LEDs, and switches may be programmable for customized processing of user input and indication, including any function implementable with processor executable instructions to be executed by either the microcontroller or digital signal processor system. In an illustrative example, there is a main output audio channel that can be used for the output of the device. In an illustrative example, there is also a secondary output audio channel that can be used for other useful signals from the digital signal processor system via the digital-to-analog converter and buffer amplifier. For example, the microphone signal, when no longer needed for training, can be routed to the secondary channel, and from there amplified separately as a vocal mic channel. In some implementations, the microcontroller subsystem functions may be performed by the digital signal processor.

Figure 7:
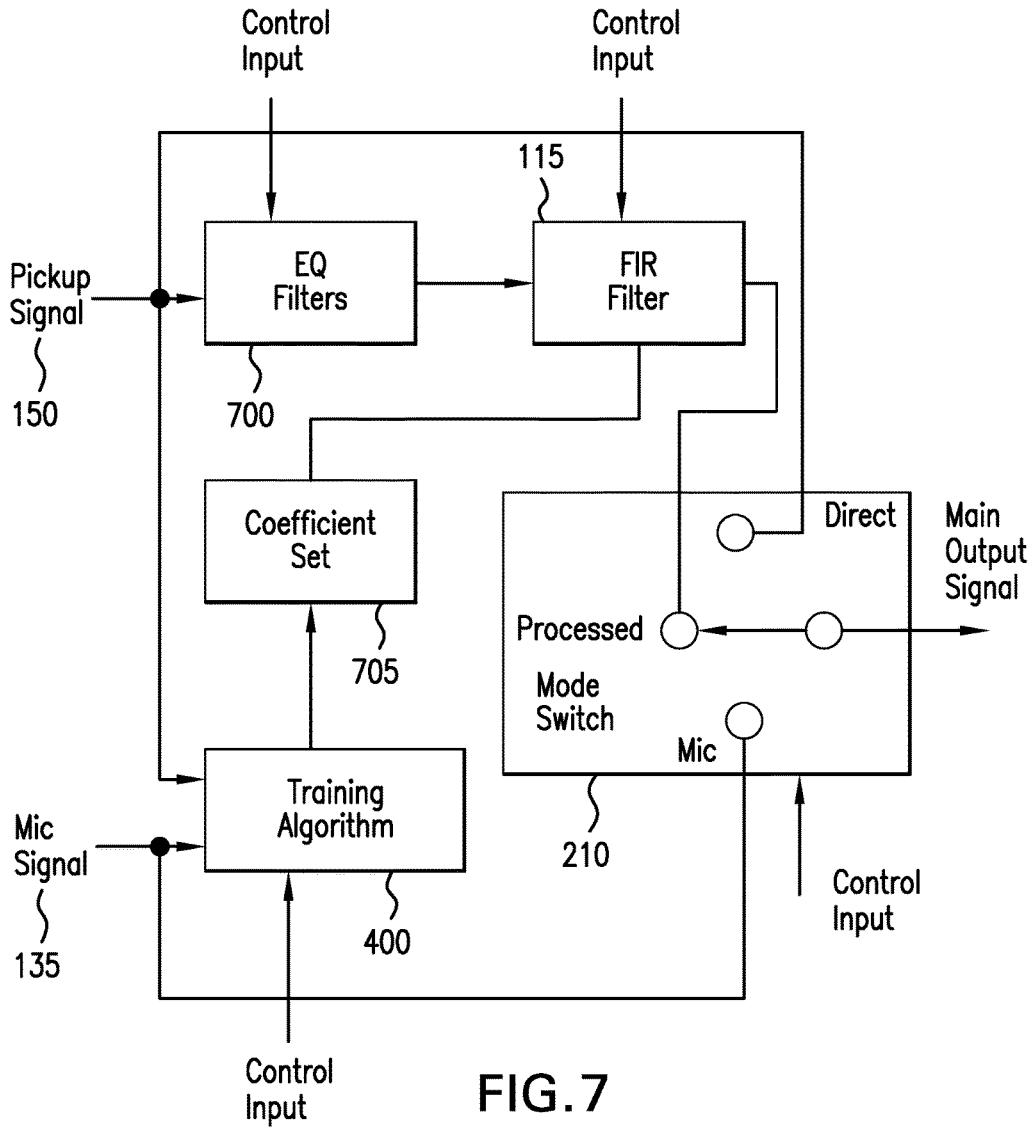
FIG. 7 depicts the operational flow of an exemplary digital signal processing system providing frequency domain training of a filter in a train mode, and translation of the pickup signal to an approximation of the microphone signal in a perform mode.

FIG. 7 depicts the operational flow of an exemplary digital signal processing system providing frequency domain training of a filter in a train mode, and translation of the pickup signal to an approximation of the microphone signal in a perform mode. In an illustrative example, mode switch 210 in perform mode selects for output pickup signal 150 processed with FIR filter 115. In an illustrative example, mode switch 210 when not in train mode selects for output either unprocessed pickup signal 150 or unprocessed microphone signal 135. In an illustrative example, pickup signal 150 may be processed with equalization filters 700 before processing with the FIR filter for output. In some implementations, the equalization filters may be after the FIR filter. In some examples, the microphone signal 135 and pickup signal 150 may be processed by training algorithm 400 to produce coefficient set 705 for FIR filter 115. In some examples, the output of an analog-to-digital converter may be routed to the equalization filters as well as the mode switch. The output of the equalization filters may be routed to the FIR filter which may be in turn routed to the mode switch. The output of an analog-to-digital converter may also be routed to the mode switch. The output of the mode switch may be routed to a digital-to-analog converter, which is connected to a buffer amplifier, providing the main output which may be routed to external sound amplification devices or headphones.

Although various embodiments have been described with reference to the Figures, other embodiments are possible. For example, some exemplary devices may advantageously provide signal processing algorithms that can automatically adjust hundreds or thousands of parameters to reconstruct the desired microphone-like sound from the instrument's pickup output signal.

Exemplary devices as disclosed herein may manipulate an acoustic body signal processing filter configured to train a set of FIR filter coefficients using block deconvolution in the frequency domain. When trained and given a signal generated by, for example, string excitation and output via an acoustic instrument pickup, the FIR filter may transform the pickup signal into a close approximation of the complex "full body" waveform that would be output from that same string excitation via a microphone that is oriented to capture the harmonics and resonances associated with the acoustic body. In simple terms, the exemplary systems as disclosed herein can train an FIR filter to translate a "flat" pickup signal (without the instrument body characteristics) into the "full body" sound with the rich harmonics and instrument body resonances for any stringed instrument, and it requires only an ordinary microphone.

The instrumentalist plays a variety of chords, scales, harmonics, or a combination during training to allow the Training Algorithm to develop a Coefficient Set that will produce desirable results. This process generally takes a few minutes or less. During this training period, the instrumentalist sits (or stands) with the instrument at an appropriate distance from the microphone, typically 1 to 2 feet, with the pickup and microphone both connected to the device. The training period terminates either as dictated by the musician, or automatically when the Training Algorithm decides that the process is complete based on a quality metric. After the training process is complete, the microphone is no longer required and can be redeployed as a vocal Mic or disconnected if not needed. The Coefficient Set thus generated is unique to the specific combination of instrument, pickup, and microphone. This coefficient Set can be stored in non-volatile memory for future use as well as present use.

Some implementations can store multiple profiles for several instruments, pickups, and microphone combinations. With a stored profile, no microphone is required for subsequent performances after the initial training session. The performer may advantageously reduce or substantially eliminate microphone feedback problems, and is not required to stand at a fixed distance from the microphone, in fact is free to move about the stage, constrained only by the cable connection to the device. Even that constraint is mitigated if a wireless instrument connection system is used.

For purposes of explanation and not limitation, an illustrative theory of operation for an exemplary implementation will now be described. In this illustrative example, assume there are two uniformly sampled signals available to the DSP via ADCs: pickup signal pic(n) and microphone signal mic(n). The algorithm is based on the assumption that mic(n) is a linear time invariant corrupted (filtered) version of pic(n). With that assumption pic(n), when convolved with the optimum set of linear filter coefficients, will generate a signal that is essentially the same as mic(n). Any linear aspects to the sound of mic(n) that depends on pic(n), will be captured by the filter to the extent that the filter tap set is long enough to encompass them. Extraneous room noise, as well as long room reverberation, will not be captured. Body resonances of the instrument, as well as the proper adjustments to undo any undesirable frequency response of the pickup, such as "piezo quack," will be captured. The signal mic(n) can be thought of as being equal to pic(n) convolved with a Finite Impulse Response Filter (FIR) with a coefficient set referred to herein as $c_{set}$. An exemplary purpose of the training algorithm may be to determine an estimate of this coefficient set $c_{set}$. This coefficient set can be inserted in the coefficient memory of the FIR Filter, thus processing the pickup signal pic(n) such that it sounds like the microphone signal. An exemplary Training Algorithm may be described as follows:

1. The microphone and pickup input samples are buffered into blocks of size 4096 or greater samples, where the block size is larger than the filter size. The filter size typically ranges from 2048 to 8192 samples.

2. The input sample blocks are transformed into the frequency domain using FFTs.

3. The complex outputs of the FFTs are divided MIC(k)/PICKUP(k), to yield a frequency domain estimate of the deconvolution.

4. The quotient vector is tested to see if it would be a constructive contributor to the training accumulator. Testing is done by comparing the quotient vector to a model developed from the known characteristics of stringed instruments. If so, it is added to the accumulator. If not, it is discarded.

5. The training accumulator is tested periodically to see if a sufficiently good result has been achieved, by comparing it to a template of what a known good filter looks like. If not, training continues as more blocks are processed. If so, the training process is considered complete and stops.

6. The resulting primary filter, still in the frequency domain, is optionally processed to alter both magnitude and phase to further enhance characteristics that are desirable for performance. For example, magnitude smoothing of certain spectral points to improve feedback immunity, and minimum phase transformation to provide a more punchy timbre. Several derivations of the primary filter may be generated.

7. The resulting filters are converted to the time domain using an IFFT for use as FIR coefficients in the convolver.

For purposes of explanation and not limitation, another illustrative theory of operation for an exemplary implementation will now be described. In this illustrative example:

x(t) is the string excitation $h_{body}(t)$ is the response of the instrument body $h_{mic}(t)$ is the response of the microphone $h_{pickup}(t)$ is the response of the pickup.

With * representing convolution, the time domain equations are:

$$\text{mic}(t)=x(t)*h_{body}(t)*h_{mic}(t)$$

$$\text{pickup}(t)=x(t)*h_{pickup}(t).$$

The frequency domain representation is then:

$$\text{MIC}(k)=X(k)\cdot H_{body}(k)\cdot H(k)$$

$$\text{PICKUP}(k)=X(k)\cdot H_{pickup}(k)$$

Next, generate a filter $H_{filt}$ by deconvolving MIC by PICKUP:

$$H_{filt}(k)=\text{MIC}(k)/\text{PICKUP}(k)=(X(k)\cdot H_{body}(k)\cdot H_{mic}(k))/(X(k)\cdot H_{pickup}(k))$$

$$H_{filt}(k)=(H_{body}(k)\cdot H_{mic}(k))/(H_{pickup}(k))$$ since the string excitation $X(k)$ cancels.

Then, change the newly created filter $H_{filt}$ (k) back to a time domain equivalent filter $h_{filt}(t)$. The mic signal is no longer needed, because the trained system can convolve the pickup signal with the $h_{filt}(t)$ to get a new signal:

$$\text{mic}\sim(t)=x(t)*h_{pickup}(t)*h_{filt}(t)$$

By substituting the definition of $h_{filt}(t)$, it can be seen that the mic~(t)=mic(t):

$$\text{mic}\sim(t)=x(t)*h_{pickup}(t)*(H_{body}(t)*H_{mic}(t))/(H_{pickup}(t))$$

This reduces to:

$$\text{mic}\neq(t)=x(t)*h_{body}(t)*h_{mic}(t).$$

In various embodiments of this process, it is not necessary to know exactly what the excitation signal is because it cancels out of the equation. The only condition is that it be sufficiently broadband over time to cover the intended frequency range of interest. To satisfy this training condition, the user may be instructed to play substantially the whole frequency range of the instrument.

Access to both the input signals and the deconvolution results in both time domain and frequency domain may allow implementing some enhancements to the filter that can significantly improve the instrumentalist's experience.

In an illustrative example, after a primary filter is generated through the training process, additional filters can be derived from the primary filter. To do so, the complex frequency domain representation is transformed into polar coordinate representation resulting in a magnitude vector and phase vector pair for each. The system can then alter the phase and magnitude response of the filter independently and intelligently, in order to provide beneficial enhancements.

In some examples, first a minimum phase version of the primary filter is derived. The primary filter and the minimum phase filter's magnitude vectors are essentially identical which means that the tonal balance may be substantially the same. But the phase vectors may be quite different. In particular and once reconstructed, the minimum phase filter may have a shorter impulse response and might sound "punchier" and "more in your face." In some implementations, this may be a very desirable modification, allowing the musician to be heard more easily in the context of an ensemble, for example.

Furthermore, the two phase vectors associated with the primary filter and the minimum phase filter can be used as inputs to an interpolation process to produce new phase vectors that are, for example, the weighted averages of the two, with intermediate levels of "punchiness." For example, a new phase vector can be generated that is the arithmetic mean of the two original phase vectors. This new averaged phase vector can be paired with the original magnitude vector and that polar coordinate combination can be transformed back to a complex frequency domain representation and ultimately back to the time domain FIR filter representation used by the convolver. This resultant interpolated filter may sound "more punchy" than the primary filter but "not quite as punchy" as the minimum phase version. Other useful filters can be generated by different interpolation or extrapolation of the phase vectors.

In similar fashion to altering phase but leaving magnitude untouched, the magnitude can be altered while leaving the phase substantially untouched. Filters that are generated through the training process can be analyzed for problematic magnitude vectors. These can be altered in order to avoid "hot notes" and/or likely sources of feedback when playing through an amplifier or public address system. For example, a magnitude vector for a typical acoustic guitar may reveal very strong resonances in the 100-200 Hz region. Experience shows that these will be likely sources of feedback, boominess, or ringing that can be quite annoying to the performer and listener. By analyzing the magnitude vector, the energy associated with these resonances can be discovered and then, for example, redistributed in such a manner as to maintain the apparent loudness of the instrument while eliminating the undesirable feedback susceptibility and tonal imbalance caused by the resonance.

Intelligent phase manipulation may advantageously be combined with intelligent magnitude manipulation to achieve many different filter alterations that are beneficial for different needs. For example, there may be a control knob used for phase blending. In some examples, a hot spot removal may be automatically done in the background, but with some user control over the degree of such compensation and the ability to turn it on and off In various embodiments, adaptive signal processing may advantageously enable creating microphone-like sound from an internal pickup. Some embodiments may provide an integrated musical performance system incorporating an adaptive algorithm to build a coefficient set in a wide range of audio environments, such as musical instrument amplifiers, general purpose sound reinforcement amplifiers, audio processing plugins designed for digital recording, and plugins designed for live sound mixing.

Various implementations may be suitable for use in diverse environments including recording studios, practice halls, demonstration setups at musical instrument industry events, or musical instrument retail stores. These, and similar environments often provide musicians with the motivation to push their playing performance, and the musical instrument, to the limit of capability, and are ideal opportunities for the benefit of improved sound and flexibility offered by exemplary devices.

Accordingly, any musician playing a wide range of notes on any acoustic resonant body instrument may quickly and conveniently, generate coefficients suitable to transform a pickup signal into a full-body microphone simulation signal. This can be readily accomplished by virtually any musician without the need to send their instrument to a lab for coefficient generation. A musician can, within a matter of minutes, generate coefficients for any of a number of instruments.

By way of example and not limitation, suitable instruments may include, but are not limited to acoustic body stringed instruments such as violin, viola, cello, mandolin, acoustic bass, banjo, ukulele, and acoustic guitar. Other types of acoustic body instruments may include wind or reed instruments, such as, for example, a trumpet, tuba, flute, piccolo, saxophone or a clarinet. Still other types of instruments may include piano, accordion, harmonica, and percussion instruments. In the case of non-stringed instruments, the excitation mechanism will be different, but for the sake of this discussion the result is the same.

Suitable pickup devices may operate on a vibration sensing or magnetic coupling to the vibratory mechanism of the instrument (e.g., a plucked guitar string). Types of pickups may include piezo, electrostatic, optical, accelerometer, magnetic, and other types of motion sensing technologies such as MEMS transducers.

Exemplary devices as disclosed herein make this process accessible to any instrumentalist. In addition, the adaptive signal processing power of exemplary devices as disclosed herein can be used also to generate alternate instrument profiles that enable one instrument to sound like another. Some implementations may be readily adaptable to transform a common instrument sound to be more like an expensive or exotic instrument by mimicking its exotic or rare frequency response characteristics, for example.

In some embodiments, a musical instrument sound adaptation devices for use by musicians may offer mechanisms to adjust the captured sound of an instrument in a studio setting, some of which may be combined with performance functions. Examples of musical instrument sound compensation systems that may be used by musicians in performance settings may include, for example, devices configurable with factory programmed instrument profiles useful for adapting the sound of a particular instrument in a studio. Such musical instrument sound compensation devices may be used by a musician to adjust the sound of a particular instrument in a performance setting, using a compensation configured in a studio by a musician.

Apparatus and associated methods relate to a device that receives a musical instrument pickup signal and a microphone signal from the musical instrument, trains a filter to translate the pickup signal into an approximation of the microphone signal by processing the pickup signal and the microphone signal in the frequency domain, and inserts the trained filter in the pickup signal path, with the microphone disconnected, permitting a musician to perform using only the adapted pickup signal. In an illustrative example, a musical instrument pickup signal and a microphone signal from the musical instrument may be sampled, segmented, and transformed to the frequency domain. FIR filter coefficients may be trained by block deconvolution in the frequency domain of the microphone signal and the pickup signal. In an illustrative example, trained FIR filter coefficients adapt the pickup signal in a performance scenario without a microphone. Some exemplary devices may receive user direction to modify the trained FIR filter coefficients for various effects.

For example, some implementations may include an initialization process used to produce a starting estimate for the coefficients, including statistically, for example, determining the likelihood that each new estimate will be a valuable contributor to an accumulated estimate.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. An acoustic instrument pickup signal compensation apparatus comprising:

a microphone input port configured to sample a microphone signal received at the input port from a microphone responsive to an undetermined broadband excitation of an acoustic body instrument;

a pickup input port configured to sample a pickup signal received at the input port from a pickup responsive to the excitation;

a first data memory configured to store a plurality of filter coefficients;

a signal processor module operatively coupled to receive the sampled microphone signal and the sampled pickup signal, and to send a plurality of trained filter coefficients to be stored in the first data memory; and, a program memory coupled to the signal processor module and containing instructions that, when executed, cause the signal processor module to perform operations to generate the trained filter coefficients, the operations comprising:

a) receive a frequency domain representation ($X_{mic}(k)$) of the sampled microphone signal;

b) receive a frequency domain representation ($X_{pic}(k)$) of the sampled pickup signal;

c) deconvolve the ($X_{mic}(k)$) with the ($X_{pic}(k)$) to generate a quotient vector; and, d) determine whether to use the generated quotient vector to generate the trained coefficients based on a comparison of the generated quotient vector to a predetermined model associated with predetermined characteristics of the acoustic body instrument.

2. The apparatus of claim 1, wherein the operations further comprise segment the sampled microphone signal and the sampled pickup signal into blocks of a length that is substantially longer than a length of the trained filter coefficients.

3. The apparatus of claim 2, wherein the length of the sample blocks is between about 2048 and 65536 samples.

4. The apparatus of claim 1, wherein the operations further comprise:

estimate the filter coefficients by deconvolving a pickup signal data block and a microphone input signal data block, wherein the frequency domain representation ($X_{mic}(k)$) comprises the microphone input data block, and wherein the received frequency domain representation ($X_{pic}(k)$) comprises the pickup signal data block.

5. The apparatus of claim 1, wherein the operations further comprise:

determine the starting estimate for the coefficients based on an impulse response at a predetermined position approximately corresponding to a delay time between the microphone signal and the pickup signal; and, determine a likelihood that each new estimate will be a valuable contributor to an accumulated estimate.

6. The apparatus of claim 1, wherein the operations further comprise:

translate the trained filter coefficients from the frequency domain to the time domain.

7. The apparatus of claim 1, wherein the operations further comprise:

engage one of a plurality of modes, the plurality of modes including: a training mode comprising operations a-d, and a perform mode that comprises convolving the received sampled pickup signal with the trained filter coefficients in the time domain.

8. The apparatus of claim 7, wherein the operations in the training mode further comprise:

automatically engage the perform mode upon completion of the training mode.

9. The apparatus of claim 1, wherein the operations further comprise:

perform, either in response to user input or automatically, further frequency domain processing on the trained accumulator, the further frequency domain processing including magnitude smoothing of predetermined spectral points.

10. The apparatus of claim 1, wherein the operations further comprise:

perform, either in response to user input or automatically, further frequency domain processing on the trained accumulator, the further frequency domain processing including minimum phase transformation.

11. The apparatus of claim 10, wherein the operations further comprise:

interpolate or extrapolate a phase response based on the minimum phase transformation and a substantially unaltered phase response of the trained accumulator.

12. The apparatus of claim 1, wherein the operations further comprise:

apply an FFT process to convert the sampled microphone input signal into the frequency domain representation ($X_{mic}(k)$), and apply an FFT process to convert the sampled pickup input signal into the frequency domain representation ($X_{pic}(k)$).

13. The apparatus of claim 1, wherein the operations further comprise:

generate and store, in response to user input, multiple sets of trained filter coefficients.

14. An acoustic instrument signal compensation apparatus comprising:

a first input port configured to sample a first signal received at the input port from a first source responsive to an undetermined broadband excitation of an acoustic body instrument;

a second input port configured to sample a second signal received at the input port from a second source responsive to the excitation;

a first data memory configured to store a plurality of filter coefficients;

a signal processor module operatively coupled to receive the sampled first signal and the sampled second signal, and to send a plurality of trained filter coefficients to be stored in the first data memory; and, a program memory coupled to the signal processor module and containing instructions that, when executed, cause the signal processor module to perform operations to generate the trained filter coefficients, the operations comprising:

a) receive a frequency domain representation ($X_1(k)$) of the sampled first signal;

b) receive a frequency domain representation ($X_2(k)$) of the sampled second signal;

c) deconvolve the ($X_1(k)$) with the ($X_2(k)$) to generate a quotient vector; and, d) determine whether to use the generated quotient vector to generate the trained coefficients based on a comparison of the generated quotient vector to a predetermined model associated with predetermined characteristics of the acoustic body instrument.

15. The apparatus of claim 14, wherein the operations further comprise segment the sampled first signal and the sampled second signal into blocks of a length that is substantially longer than a length of the trained filter coefficients.

16. The apparatus of claim 14, wherein the operations further comprise:

estimate the filter coefficients by deconvolving a second signal data block and a first input signal data block, wherein the frequency domain representation ($X_1(k)$) comprises the first input data block, and wherein the received frequency domain representation ($X_2(k)$) comprises the second signal data block.

17. The apparatus of claim 14, wherein the operations further comprise:

engage one of a plurality of modes, the plurality of modes including: a training mode comprising operations a-d, and a perform mode that comprises convolving the received sampled second signal with the trained filter coefficients in the time domain; and, translate the trained filter coefficients from the frequency domain to the time domain.

18. The apparatus of claim 14, wherein the operations further comprise:

apply an FFT process to convert the sampled first input signal into the frequency domain representation ($X_1(k)$), and apply an FFT process to convert the sampled second input signal into the frequency domain representation ($X_2(k)$).

19. An acoustic instrument signal compensation apparatus comprising:

a first input port configured to sample a first signal received at the input port from a first source responsive to an undetermined broadband excitation of an acoustic body instrument;

a second input port configured to sample a second signal received at the input port from a second source responsive to the excitation;

a first data memory configured to store a plurality of filter coefficients;

a signal processor module operatively coupled to receive the sampled first signal and the sampled second signal, and to send a plurality of trained filter coefficients to be stored in the first data memory; and, means coupled to the signal processor module for causing the signal processor module to perform operations to generate a quotient vector and determine whether to use the generated quotient vector to generate the trained coefficients based on a comparison of the generated quotient vector to a predetermined model associated with predetermined characteristics of the acoustic body instrument.

20. The apparatus of claim 19, wherein the first source is selected from the group consisting of: a microphone and an instrument pickup; and, wherein the second source is selected from the group consisting of: a microphone and an instrument pickup.

21. The apparatus of claim 1, wherein the comparison of the generated quotient vector to a predetermined model is performed in the time domain.

22. The apparatus of claim 1, wherein the comparison of the generated quotient vector to a predetermined model is performed in the frequency domain.

* * * * *